United States Patent [19]

Grasis et al.

[11] 3,984,719

[45] Oct. 5, 1976

[54] INTERNALLY SEALED LAMP

[75] Inventors: Egils M. Grasis, Campbell; Joseph R. Caruso, San Jose, both of Calif.

[73] Assignee: ILC Technology, Inc., Sunnyvale, Calif.

[22] Filed: May 15, 1975

[21] Appl. No.: 577,727

[52] U.S. Cl. ..... 313/217; 313/331; 313/332

[51] Int. Cl.[2] ..... H01J 61/06

[58] Field of Search ..... 313/217, 331, 332; 174/77 R

[56] References Cited

UNITED STATES PATENTS 3,450,924 6/1969 Knochel et al. ..... 313/332 X

*Primary Examiner*—R. V. Rolinec
*Assistant Examiner*—Darwin R. Hostetter
*Attorney, Agent, or Firm*—Boone, Schatzel, Hamrick & Knudsen

[57] ABSTRACT

A light source lamp apparatus having a lamp housing envelope with a circular opening and an electrode assembly disposed and sealed within the interior of the envelope about said opening. The electrode assembly includes an electrode support shaft with an electrode mounted about one end and a cylindrical shoulder intermediate the electrode and the other end; a compression ring coaxial with the shaft and positioned in tandem with the shouler to form a seat for receiving an elastometer O-ring intermediate the compression ring and the shoulder; an elastometer O-ring positioned within said seat; pressure control means coupled to said compression ring for compressing the seat and expanding the outer diameter of the O-ring to cause the outer peripheral surface of said O-ring to interface with the interior surface of the envelope and seal said envelope and said O-ring.

10 Claims, 2 Drawing Figures

INTERNALLY SEALED LAMP

BACKGROUND OF THE INVENTION

1. Field of the Invention

The present invention relates generally to a light source lamp, and more particularly to a light source lamp having an internal seal for sealing the lamp envelope about the electrodes.

2. Description of the Prior Art

Various light source lamps, e.g., arc lamps and flash lamps, exist in the prior art. In manufacturing light source lamps, a problem to be overcome is to provide an economical seal between the electrical feed through and the lamp envelope while also producing a reliable high voltage insulation system to prevent high voltage arcing to adjacent metal structures and lamp-mounting surfaces.

The prior art includes both inside and outside seals with indium based solder and high temperature glass or quartz envelope-to-tungsten seals. Seals made on the outside diameter of a quartz envelope commonly have a disadvantage in that the high voltage insulation system is difficult to design and manufacture in the available space. High temperature quartz-to-tungsten seals have the disadvantage of being brittle and require highly skilled technicians to fabricate the seals. The difference in the coefficients of expansion of the envelope material and the metal pose difficulties with the varying temperatures.

SUMMARY OF THE PRESENT INVENTION

An object of the present invention is to provide a light source lamp having a reliable internal electrode-to-envelope seal comprised of economical components and which may be assembled by relatively unskilled labor.

A further object is to provide a light source lamp in which the envelope may serve as a high voltage insulator.

Briefly, a preferred embodiment includes a cylindrical lamp envelope and an internal electrode assembly having a metallic conductive shaft with an electrode mounted at one end. Intermediate its ends, the shaft forms a cylindrical shoulder having an outer diameter slightly less than the inner diameter of the envelope. A compression ring encompasses the shaft and is positioned in tandem relationship to the shoulder to form a seal intermediate the end of the shoulder and the end of the compression ring. The compression ring is slidable along the shaft axis so as to allow for variations in the width of the seat. An elastic O-ring having an outer diameter slightly less than the internal diameter of the envelope is positioned within the seat. A compression adjustment means for adjusting the lateral position of the compression ring relative to the shoulder is provided such that the expansion of the outer peripheral surface of the O-ring is controlled responsive to the width of the seat. As the seat width is decreased the outer peripheral surface of the O-ring and the interface contact of the O-ring and internal surface of the envelope increase to provide a seal. A central canal penetrates through the electrode shaft and communicates from the interior of the envelope adjacent to the electrode to the exterior of the envelope.

Light source lamps in accord with the present invention provide a reliable internal envelope-to-electrode seal of which the component parts are economical and which may be assembled by relatively unskilled personnel. The assembled structure provides a source lamp which does not require a metal-to-glass seal, thereby overcoming the difficulties in compensating for the difference in the coefficients of expansion between metals and nonmetals.

These and other objects and advantages of the present invention will become apparent after a reading of the following detailed description of a preferred embodiment illustrated in the figures of the drawing.

IN THE DRAWING

FIG. 1 is a side cross-sectional view of a light source lamp of the present invention; and FIG. 2 is a perspective exploded view of one of the electrode assemblies of the lamp in FIG. 1.

DETAILED DESCRIPTION OF THE PREFERRED EMBODIMENT

Figure 1:
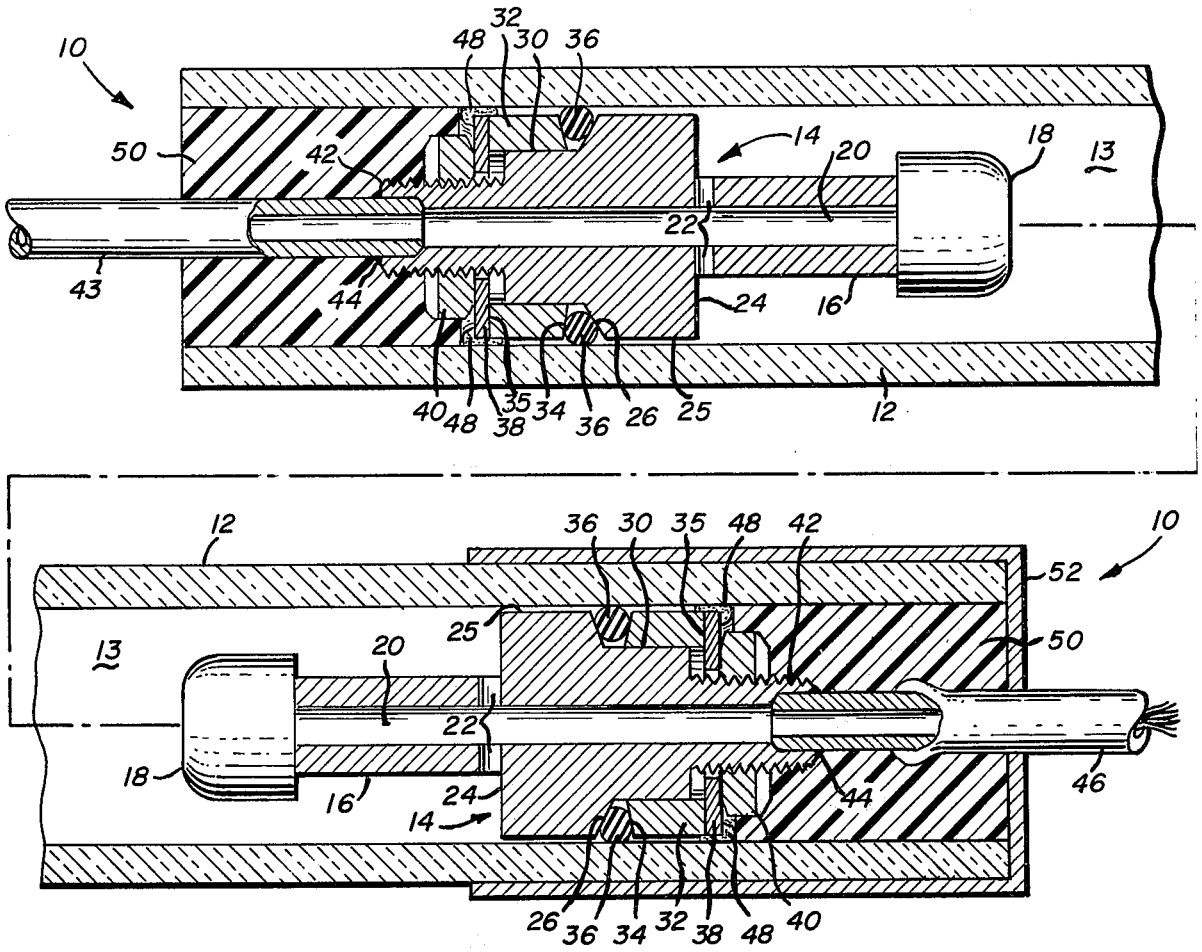
Figure 2:
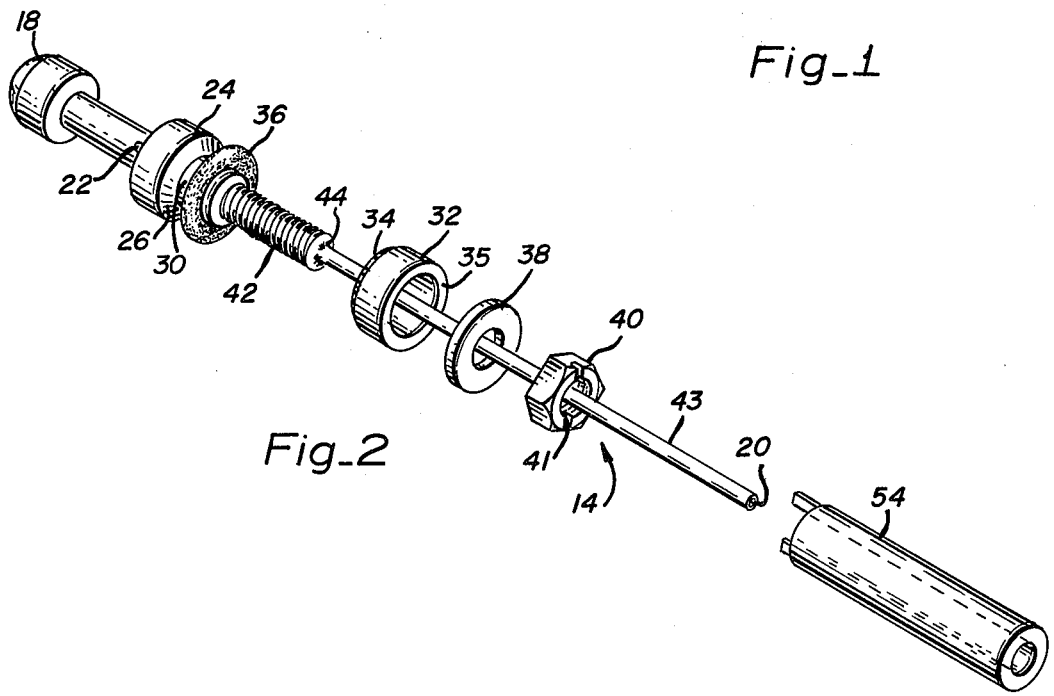

FIG. 1 illustrates a light source lamp in the form of a flash lamp, generally referred to by the general reference character 10, in accord with the present invention. Lamp 10 includes a right cylindrical quartz envelope 12 with an internal cavity 13. An electrode assembly 14 is positioned within and about each end of the cavity 13 with one serving as the cathode and the other as the anode. The electrode assemblies 14 are preferably comprised of highly conductive materials, e.g., copper, stainless steel, etc.

The two illustrated electrode assemblies 14 are structurally identical and therefore carry the same reference numerals. Each electrode assembly 14 includes an electrode support shaft 16. A tungsten electrode 18 is electrically connected to and physically supported about the end of the shaft 16 within the cavity 13. Within the shaft 16 is a central canal 20 which opens to the cavity 13 by means of a port 22 extending through a side wall of the shaft. Canal 20 extends from the port 22 to the external end of the shaft 16. A cylindrical shoulder 24 is formed at a position intermediate the ends of the shaft 16. The shoulder 24 has an outer wall surface 25 coaxial with the envelope 12. The diameter of the outer surface 25 is slightly less than the diameter of the interior surface of the envelope 12 to permit the shaft to be slid within the envelope. The shoulder 24 has a tapered end wall 26 interconnecting the wall 25 with an intermediate cylindrical surface 30.

A cylindrical compression ring 32 is positioned over the surface 30. Ring 32 has a tapered end wall 34 facing the tapered wall 26 and an end wall 35 about the other end. The combination of the walls 26, 30 and 34 forms a V-shaped seat for receiving an elastometer O-ring 36. The O-ring 36 is selected such that its natural unbiased outer diameter is substantially equal to the inner diameter of the envelope 12. The inner diameter of the O-ring 36 is selected to be substantially equal to that of the surface 30. The compression ring 32 is slidable axially along the surface 30. Abutting the end wall 35 of the compression ring 32 is a ring washer 38. Abutting the washer 38 is a threaded backing nut 40 threaded to a threaded end portion 42 of the shaft. The nut 40 has a pair of slots 41 for receiving the tinges of an adjustment tool.

Extending from the end of the shaft 16 is a cylindrical hollow type conductor 43. The conductor 43 is held in place to the shaft 16 by a solder joint 44 and provides an extension of the canal 20. Joined to the conductor 43 is a flexible lead cable 46 to provide a means for connecting the lamp 10 to an external power supply. An adhesive epoxy 48 adheres the backing nut 40 to the inside wall of the tube 12 to secure it in place once adjustments are completed. The end of the envelope 12 about the end of the electrode 14 is potted with a potting compound 50. A radiation shield 52 is positioned over the end of the envelope 12 and extends axially beyond the location of the O-ring 36. (Shield 52 is only illustrated about one end though in the final assembly, shields 52 are placed about each end.)

In assembling the lamp 10 in accord with the present invention, first one of the electrode assemblies 14 is slid through one end of the envelope 12 to within the cavity 13. Envelope 12 is formed of a material having low absorption of the desired output light and which is nonreactive with the charge material. Quartz is usually selected as the envelope material. However, glass and other materials may be used. Once the electrode assembly 14 is in place, an adjustment tool 54 is grasped by the assembler. The tinges of the tool are inserted within the slots 41 of the backing nut 40. Then through control of the tool, the backing nut is threaded onto the shaft 16 so as to urge the washer 38 and compression ring 32 towards the stationary soulder 24 thereby decreasing the cross-sectional spacing of the formed V-shaped seat. As the spacing of the seat decreases, the O-ring is forced outward with the outer peripheral surface of the O-ring interfacing with the inner diameter wall surface of the envelope 12. The interface contact and pressure between the O-ring and the envelope wall creates a vacuum seal. Adhesive epoxy 48 is placed about the external periphery of the backing nut 48 and inner surface of the envelope 12 to mechanically secure the envelope and electrode assembly 14 in place. The same process is then repeated at the opposite end of the envelope with the other electrode assembly. After both electrode assemblies 14 are in place, one of the conductors 42 is pinched off and sealed. Then, a vacuum pump is connected to the conductor 43 of the other assembly 14 to evacuate air from the interior of the cavity 13. After evacuation, an inert gas, e.g., xenon is pumped into the cavity 13 through the canal 20. After the desired amount of gas is induced, the pump is removed and the conductor 43 is pinched and sealed. The conductor cables 46 are then attached to the conductors 43 and the potting compound 50 inserted about the ends of the envelope 12. The shields 52 are then placed over the ends.

In operation, the quartz envelope functions as a high voltage insulator. Also, the shoulder 24 provides a radiation shield to protect the O-ring 36 from damage by the plasma during operation. The exterior shield 52 provides protection to the O-ring 34 from ultraviolet radiation originating with exterior sources. Commonly, during operation, pressure within the cavity 13 momentarily increases. The adhesive epoxy 48 serves to mechanically hold the envelope 12 and the electrode assembly 14 in place to resist the pressure increases.

While, for the sake of clearness and in order to disclose the invention so that the same can be readily understood, a specific embodiment has been described and illustrated, it is to be understood that the present invention is not limited to the specific means disclosed. It may be embodied in other ways that may suggest themselves to persons skilled in the art. It is believed that this invention is new and that all changes that come within the scope of the following claims are to be considered as part of this invention.

What is claimed is:

1. A light source lamp comprising, in combination:

a lamp housing envelope having a circular opening to an internal cavity formed by the envelope; and an electrode assembly positioned within the cavity about said opening, the electrode assembly including an electrode mounted within the cavity about one end of an electrode support shaft, the shaft having a shoulder intermediate the electrode and its other end, said shoulder having an outer diameter less than the inner diameter of the envelope, a compression ring about and coaxial with said shaft, the compression ring being intermediate said shoulder and the other end to form a seat intermediate the shoulder and the compression ring, an elastometer O-ring positioned within said seat, said O-ring having a natural outer diameter substantially equal to the inner diameter of the housing envelope, pressure control means coupled to said compression ring for urging said compression ring towards said shoulder to control the cross section of said seat and controlling the expansion of the diameter of said O-ring and the interface seal between the outer peripheral surface of said O-ring and the inner surface of said envelope.

2. The light source lamp of claim 1 wherein said shaft has a canal extending from said other end to the interior of the envelope.

3. The light source lamp of claim 1 wherein the pressure control means includes a secondary threaded shoulder on said support shaft and coaxial with said compression ring, an adjustment nut threaded to said secondary shoulder and coupled to the side surfaces of said compression ring whereby the spacing intermediate the compression ring and shoulder is controllable responsive to the position of the adjustment nut on the secondary shaft.

4. The light source lamp of claim 3 wherein said shaft has a canal extending from said other end to the interior of the envelope.

5. The light source lamp of claim 1 wherein the shoulder is in the form of a right circular cylinder forming a tapered end wall, the compression ring is in the form of a sleeve with a tapered end wall facing the tapered end wall of the shoulder, and said O-ring is intermediate the tapered side walls of the shoulder and the compression ring.

6. The light source of claim 5 wherein the pressure control means includes a secondary threaded shoulder on said support shaft and coaxial with said compression ring whereby the spacing intermediate the compression ring and shoulder is controllable responsive to the position of the adjustment nut on the secondary shaft.

7. The light source of claim 6 wherein said shaft has a canal extending from said other end to the interior of the envelope.

8. The light source of claim 7 further including adhesive means for adhering the adjustment nut to the inside wall surface of envelope; whereby after the adjustment nut is adjusted to seat the O-ring in place the electrode assembly may be further physically anchored in place to the envelope.

9. The light source of claim 8 wherein the adjustment nut has tool receiving means for receiving an adjustment tool; whereby adjustment of the adjustment nut may be made from the exterior of the envelope.

10. The light source of claim 1 wherein the lamp housing has a pair of circular openings; and an electrode assembly is disposed within the interior of the envelope about each opening, each electrode assembly including an electrode mounted about one end of an electrode support shaft and within the cavity, the shaft having a shoulder intermediate the attached electrode and the other end, the diameter of the outer surface of the shoulder being less than the inner diameter of the envelope adjacent to the shoulder, a compression ring about and coaxial with each shaft, the compression rings being intermediate the shoulder and other end of the associated electrode assembly, an elastometer O-ring coaxial with the shaft and positioned intermediate each of said shoulders and said compression rings, the O-rings each having a natural outer diameter substantially equal to the inner diameter of the envelope, pressure control means coupled to each of said compression rings for urging said compression rings toward said shoulders and expanding the diameter of said O-ring intermediate said shoulder and said compression ring to cause the outer peripheral surface of said O-rings to expand and seal the interface between the inner surface of said envelope and said O-rings.

* * * * *